US011713608B2

(12) United States Patent
Yulkowski et al.

(10) Patent No.: US 11,713,608 B2
(45) **Date of Patent: *Aug. 1, 2023**

(54) DOOR MONITORING SYSTEM

(71) Applicant: TD IP HOLDCO, LLC, Waterford, MI (US)

(72) Inventors: Patricia Yulkowski, Pontiac, MI (US); Leon Yulkowski, Bloomfield Hills, MI (US); Edward J. Yenni, Avon Lake, OH (US)

(73) Assignee: TD IP HOLDCO, LLC, Waterford, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/316,976

(22) Filed: May 11, 2021

(65) Prior Publication Data

US 2021/0404236 A1 Dec. 30, 2021

Related U.S. Application Data

(63) Continuation of application No. 16/546,066, filed on Aug. 20, 2019, now Pat. No. 11,028,630, which is a (Continued)

(51) Int. Cl.
*E05F 15/41* (2015.01)
*E05F 15/70* (2015.01)
(Continued)

(52) U.S. Cl.
CPC ..... *E05F 15/41* (2015.01); *E05F 15/00* (2013.01); *E05F 15/40* (2015.01); *E05F 15/70* (2015.01);
(Continued)

(58) Field of Classification Search
CPC . E05F 15/00; E05F 15/40; E05F 15/41; E05F 15/70; E05F 15/603; E06B 7/28;
(Continued)

(56) References Cited

U.S. PATENT DOCUMENTS 1,684,704 A 9/1928 Hubbell
2,435,779 A 2/1948 Guilbert, Jr.
(Continued)

FOREIGN PATENT DOCUMENTS

CA 2509669 7/2005
DE 10 2007 038 421 9/2008
(Continued)

OTHER PUBLICATIONS

May 5, 2021, U.S. Appl. No. 16/455,510.
(Continued)

*Primary Examiner* — Andrew W Bee
(74) *Attorney, Agent, or Firm* — Evan Law Group LLC

(57) ABSTRACT

A door assembly includes a first door skin and a second door skin spaced apart from the first door skin. The assembly also includes an energy sensor generating an energy signature signal and a memory storing a door component operating signature. A controller is coupled to the accelerometer and forms a comparison of the energy signature signal to the door component operating signature and generates a door component operation status signal in response to the comparison.

20 Claims, 13 Drawing Sheets

Related U.S. Application Data continuation of application No. 16/019,385, filed on Jun. 26, 2018, now Pat. No. 10,415,294, which is a continuation of application No. 15/389,086, filed on Dec. 22, 2016, now Pat. No. 10,024,096, which is a continuation of application No. 14/547,434, filed on Nov. 19, 2014, now Pat. No. 9,536,357, which is a continuation of application No. 14/139,699, filed on Dec. 23, 2013, now Pat. No. 8,907,791, which is a continuation of application No. 12/837,194, filed on Jul. 15, 2010, now Pat. No. 8,653,982.

(60) Provisional application No. 61/227,277, filed on Jul. 21, 2009.

(51) Int. Cl.

| | |
|---|---|
| ***G07C 9/00*** | (2020.01) |
| ***E05F 15/40*** | (2015.01) |
| ***G07C 5/08*** | (2006.01) |
| ***G08B 21/18*** | (2006.01) |
| ***E05F 15/00*** | (2015.01) |
| ***E06B 7/28*** | (2006.01) |
| ***G08B 21/04*** | (2006.01) |
| *E05F 15/603* | (2015.01) |

(52) U.S. Cl.

CPC ..... *E06B 7/28* (2013.01); *G07C 5/0816* (2013.01); *G07C 9/00571* (2013.01); *G08B 21/043* (2013.01); *G08B 21/18* (2013.01); *E05F 15/603* (2015.01); *E05Y 2400/44* (2013.01); *E05Y 2400/458* (2013.01); *E05Y 2400/502* (2013.01); *E05Y 2400/54* (2013.01); *E05Y 2400/554* (2013.01); *E05Y 2800/73* (2013.01); *E05Y 2900/132* (2013.01)

(58) Field of Classification Search

CPC .... G08B 21/043; G08B 21/18; G07C 5/0816; G07C 9/00571; E05Y 2400/44; E05Y 2400/54; E05Y 2400/554; E05Y 2400/458; E05Y 2400/502; E05Y 2900/132; E05Y 2800/73

See application file for complete search history.

(56) References Cited

U.S. PATENT DOCUMENTS 2,958,089 A 11/1960 Roehm
3,039,764 A 6/1962 Heinsman et al.
3,699,717 A 10/1972 Hedrick
3,955,365 A 5/1976 Arao
3,968,651 A 7/1976 Walworth
4,093,284 A 6/1978 Yulkowski
4,333,268 A 6/1982 Dumbeck
4,501,090 A 2/1985 Yoshida
4,545,607 A 10/1985 Yulkowski
4,562,664 A * 1/1986 Kambic ..... G08B 13/08 74/531
4,660,250 A 4/1987 Tillman et al.
4,698,937 A 10/1987 Kombrekke et al.
4,727,679 A 3/1988 Kornbrekke et al.
4,748,771 A 6/1988 Lehnert
4,952,080 A 8/1990 Boiucaner et al.
4,980,618 A 12/1990 Milnes et al.
5,006,766 A 4/1991 Yuhas
5,018,304 A 5/1991 Longoria
5,040,331 A 8/1991 Merendino et al.
5,063,316 A 11/1991 E-Ming
5,072,973 A 12/1991 Gudgel et al.
5,188,193 A 2/1993 Schroeder
5,250,765 A 10/1993 Mizuno et al.
5,289,162 A * 2/1994 McDaniel ..... F25D 29/008 340/521
5,349,782 A 9/1994 Yulkowski
5,375,374 A 12/1994 Rohraff, Sr.
5,392,562 A 2/1995 Carambula
5,488,896 A 2/1996 Current
5,518,461 A 5/1996 Pfordt
5,583,405 A 12/1996 Sai et al.
5,687,507 A 11/1997 Beran
5,770,934 A 6/1998 Theile
5,813,171 A 9/1998 Piltingsrud
5,878,530 A 3/1999 Eccleston et al.
5,881,497 A 3/1999 Borgardt
5,913,763 A 6/1999 Beran et al.
6,034,494 A 3/2000 Kitamine et al.
6,049,287 A 4/2000 Yulkowski
6,108,975 A 8/2000 Bailey
6,154,924 A 12/2000 Woo
6,183,023 B1 2/2001 Yulkowski
6,223,469 B1 * 5/2001 Moll ..... E05F 15/611 49/339
6,259,352 B1 7/2001 Yulkowski et al.
6,316,892 B1 11/2001 Valencia
6,318,024 B1 11/2001 Krsnak et al.
6,322,221 B1 11/2001 van de Loo
6,334,276 B1 1/2002 Marin-Martinod et al.
6,336,294 B1 1/2002 Kowalczyk et al.
6,338,693 B1 1/2002 Scholten et al.
6,481,160 B1 11/2002 Kowalczyk
6,553,238 B1 4/2003 Ginzel et al.
6,553,717 B2 4/2003 St. John et al.
6,581,332 B1 6/2003 Kim
6,588,153 B1 7/2003 Kowalczyk
6,700,542 B2 3/2004 Borlez
6,705,047 B2 3/2004 Yulkowski
6,715,586 B1 4/2004 Shubin
6,724,304 B2 * 4/2004 Risi ..... E05G 5/02 49/31
6,751,909 B2 6/2004 Ranaudo
6,788,000 B2 9/2004 Appelberg et al.
6,854,565 B2 2/2005 Peralaet et al.
6,891,479 B1 5/2005 Eccleston
6,967,451 B2 11/2005 Miyauchi
6,970,085 B2 11/2005 Okabe et al.
6,988,594 B2 1/2006 Deplazes et al.
7,070,226 B2 7/2006 Cleland et al.
7,143,547 B2 12/2006 Liles, Jr.
7,143,548 B2 12/2006 Kleinmann et al.
7,145,436 B2 12/2006 Ichikawa et al.
7,224,275 B2 5/2007 Fitzgibbon
7,263,802 B2 9/2007 Fitzgibbon et al.
7,316,096 B2 1/2008 Houser et al.
7,382,063 B2 6/2008 Mullet et al.
7,418,800 B1 9/2008 Sellman
7,493,726 B2 2/2009 Fitzgibbon et al.
7,621,083 B2 11/2009 Smith
7,999,690 B1 * 8/2011 Shi ..... G08B 21/22 340/666
8,261,491 B2 9/2012 Yulkowski et al.
8,381,617 B2 2/2013 Holt et al.
8,405,337 B2 3/2013 Gebhart
8,653,982 B2 * 2/2014 Yulkowski ..... E05F 15/00 73/493
8,844,200 B2 9/2014 Yulkowski et al.
8,907,791 B2 * 12/2014 Yulkowski ..... E05F 15/40 340/540
9,536,357 B2 * 1/2017 Yulkowski ..... E05F 15/70
9,651,130 B2 5/2017 Yulkowski
10,024,096 B2 * 7/2018 Yulkowski ..... G07C 5/0816
10,087,674 B2 10/2018 Rochon
10,221,609 B2 3/2019 Yulkowski et al.
10,378,262 B2 8/2019 Yulkowski
10,415,294 B2 * 9/2019 Yulkowski ..... G08B 21/043
11,028,630 B2 * 6/2021 Yulkowski ..... E06B 7/28
11,098,517 B2 8/2021 Yulkowski
11,199,041 B2 12/2021 Yulkowski et al.
2002/0026750 A1 3/2002 St. John et al.
2002/0092237 A1 7/2002 Hebda

(56) References Cited

U.S. PATENT DOCUMENTS

| | | | | |
|---|---|---|---|---|
| 2002/0104266 | A1* | 8/2002 | Ranaudo | G05B 19/042 49/334 |
| 2002/0178655 | A1 | 12/2002 | Pedemonte | |
| 2003/0005639 | A1 | 1/2003 | Kowaiczyk | |
| 2003/0213177 | A1 | 11/2003 | Fitzgibbon et al. | |
| 2003/0217894 | A1* | 11/2003 | Perala | B66B 13/00 187/316 |
| 2004/0046418 | A1 | 3/2004 | Chikata | |
| 2004/0182234 | A1 | 9/2004 | Busch | |
| 2004/0187387 | A1 | 9/2004 | Hedrich | |
| 2004/0251868 | A1* | 12/2004 | Sato | E05F 15/632 318/652 |
| 2005/0091928 | A1 | 5/2005 | Okulov | |
| 2005/0098388 | A1 | 5/2005 | Studhalter | |
| 2005/0193652 | A1 | 9/2005 | Comell | |
| 2005/0198063 | A1* | 9/2005 | Thomas | G05B 15/02 707/999.102 |
| 2005/0217097 | A1* | 10/2005 | Solfronk | B21J 15/285 29/243.521 |
| 2006/0048466 | A1 | 3/2006 | Damell | |
| 2006/0167656 | A1* | 7/2006 | Shimonishi | H04Q 9/00 702/182 |
| 2006/0175147 | A1 | 8/2006 | Morotome | |
| 2006/0197481 | A1 | 9/2006 | Hotto et al. | |
| 2006/0207199 | A1 | 9/2006 | Damell | |
| 2006/0244271 | A1* | 11/2006 | Hass | E05F 15/70 292/336.3 |
| 2006/0267409 | A1 | 11/2006 | Mullet et al. | |
| 2006/0293821 | A1 | 12/2006 | Takahashi | |
| 2007/0108927 | A1 | 5/2007 | Valencia et al. | |
| 2007/0193220 | A1 | 8/2007 | Daniels | |
| 2008/0061963 | A1* | 3/2008 | Schnitz | G06Q 20/203 340/539.13 |
| 2008/0154467 | A1 | 6/2008 | Evans et al. | |
| 2008/0168714 | A1 | 7/2008 | Watanabe | |
| 2008/0203760 | A1 | 8/2008 | Cafeo et al. | |
| 2008/0209228 | A1* | 8/2008 | Chandler | G07C 9/20 713/186 |
| 2008/0246607 | A1 | 10/2008 | Smith | |
| 2009/0185197 | A1* | 7/2009 | Wilson | H02P 29/02 358/1.1 |
| 2009/0186736 | A1 | 7/2009 | Ta | |
| 2009/0249699 | A1 | 10/2009 | Yulkowski | |
| 2010/0083598 | A1 | 4/2010 | Smith | |
| 2010/0114525 | A1* | 5/2010 | Ollivier | B62D 65/005 702/158 |
| 2010/0242368 | A1 | 9/2010 | Yulkowski | |
| 2011/0016971 | A1 | 1/2011 | Yulkowski et al. | |
| 2012/0210647 | A1 | 8/2012 | McKibben et al. | |
| 2013/0118079 | A1 | 5/2013 | Yulkowski et al. | |
| 2013/0199321 | A1 | 8/2013 | Oberle | |
| 2014/0182206 | A1 | 7/2014 | Yulkowski et al. | |
| 2014/0325911 | A1 | 11/2014 | Hass | |
| 2015/0059249 | A1 | 3/2015 | Yulkowski | |
| 2015/0135596 | A1 | 5/2015 | Cooper | |
| 2015/0137963 | A1 | 5/2015 | Yulkowski et al. | |
| 2016/0033024 | A1 | 2/2016 | Yulkowski | |
| 2016/0115725 | A1 | 4/2016 | Yulkowski | |
| 2016/0273617 | A1 | 9/2016 | Nickel | |
| 2017/0152696 | A1 | 6/2017 | Yulkowski et al. | |
| 2018/0051509 | A1 | 2/2018 | German | |
| 2018/0119472 | A1 | 5/2018 | Hucker | |
| 2018/0371817 | A1 | 12/2018 | Yulkowski et al. | |
| 2019/0169912 | A1 | 6/2019 | Yulkowski et al. | |
| 2019/0336801 | A1 | 11/2019 | Edwards | |
| 2020/0071982 | A1 | 3/2020 | Yulkowski et al. | |
| 2020/0165857 | A1 | 5/2020 | Yulkowski | |
| 2021/0404236 | A1 | 12/2021 | Yulkowski et al. | |
| 2022/0010606 | A1 | 1/2022 | Yulkowski | |
| 2022/0136313 | A1 | 5/2022 | Yulkowski et al. | |

FOREIGN PATENT DOCUMENTS

| | | |
|---|---|---|
| DE | 10 2009 027 702 | 2/2010 |
| EP | 0 243 786 | 4/1987 |
| EP | 0 363 642 | 4/1990 |
| EP | 1418121 | 5/2004 |
| EP | 1 898 036 | 3/2008 |
| EP | 15748099.7 | 1/2019 |
| EP | 15748099.7 | 5/2019 |
| EP | 15748099.7 | 7/2021 |
| FR | 452 468 | 5/1913 |
| GB | 1304713 | 1/1973 |
| JP | H03 51562 | 3/1991 |
| WO | 2008/078029 | 7/2008 |
| WO | 2009/137849 | 11/2009 |

OTHER PUBLICATIONS

May 12, 2021, U.S. Appl. No. 16/546,066.
Jun. 7, 2021, U.S. Appl. No. 16/211,023.
Aug. 16, 2021, U.S. Appl. No. 16/211,023.
Sep. 7, 2022, U.S. Appl. No. 17/316,976.
Sep. 28, 2022, U.S. Appl. No. 17/383,081.
Dec. 29, 2022, U.S. Appl. No. 17/383,081.
International Search Report dated Jun. 18, 2010 for PCT application No. PCT/US2010/027423.
International Search Report dated Jan. 19, 2016 for PCT application No. PCT/US2015/041006.
May 1, 2012, U.S. Appl. No. 12/719,954.
May 8, 2012, U.S. Appl. No. 12/416,622.
Jan. 30, 2012, U.S. Appl. No. 12/416,622.
Sep. 16, 2011, U.S. Appl. No. 12/416,622.
Jul. 25, 2011, U.S. Appl. No. 12/416,622.
Apr. 20, 2012, U.S. Appl. No. 12/416,622.
Oct. 23, 2012, U.S. Appl. No. 12/719,954.
Jul. 5, 2012, U.S. Appl. No. 12/719,954.
Jun. 5, 2012, U.S. Appl. No. 12/719,954.
Oct. 4, 2011, PCT/US2010/027423.
Jun. 18, 2010, PCT/US2010/027423.
Feb. 2, 2012, PCT/US2010/042286.
Apr. 13, 2011, PCT/US2010/042286.
Jan. 28, 2013, U.S. Appl. No. 12/837,194.
Feb. 14, 2013, U.S. Appl. No. 12/719,954.
May 7, 2013, U.S. Appl. No. 12/719,954.
May 13, 2013, U.S. Appl. No. 13/589,471.
Jul. 11, 2013, U.S. Appl. No. 12/719,954.
Jul. 30, 2013, U.S. Appl. No. 12/719,954.
Aug. 27, 2013, U.S. Appl. No. 12/837,194.
Oct. 3, 2013, U.S. Appl. No. 12/719,954.
Oct. 3, 2013, U.S. Appl. No. 13/589,471.
May 19, 2014, U.S. Appl. No. 14/139,699.
May 29, 2014, U.S. Appl. No. 12/719,954.
Jun. 4, 2014, U.S. Appl. No. 13/589,471.
Jul. 24, 2014, U.S. Appl. No. 14/139,699.
Dec. 23, 2014, U.S. Appl. No. 13/589,471.
Sep. 2, 2014, U.S. Appl. No. 14/139,699.
Oct. 16, 2014, U.S. Appl. No. 14/139,699.
Jun. 11, 2015, U.S. Appl. No. 13/589,471.
Jun. 30, 2015, U.S. Appl. No. 14/485,452.
Feb. 9, 2016, U.S. Appl. No. 14/485,452.
Feb. 11, 2016, U.S. Appl. No. 14/547,434.
Feb. 19, 2016, U.S. Appl. No. 13/589,471.
Jul. 14, 2016, U.S. Appl. No. 13/589,471.
Jun. 13, 2016, U.S. Appl. No. 13/589,471.
Jun. 16, 2016, U.S. Appl. No. 14/485,452.
Jun. 20, 2016, U.S. Appl. No. 13/589,471.
Jul. 6, 2016, U.S. Appl. No. 13/589,471.
Sep. 8, 2016, U.S. Appl. No. 13/589,471.
Sep. 8, 2016, U.S. Appl. No. 14/547,434.
Sep. 20, 2016, U.S. Appl. No. 14/547,434.
Dec. 2, 2016, U.S. Appl. No. 14/547,434.
Dec. 21, 2016, U.S. Appl. No. 14/485,452.
Jan. 24, 2017, U.S. Appl. No. 13/589,471.

(56) References Cited

OTHER PUBLICATIONS

Jun. 26, 2017, U.S. Appl. No. 14/485,452.
Jul. 5, 2017, U.S. Appl. No. 14/485,452.
Jul. 20, 2017, U.S. Appl. No. 14/485,452.
Sep. 19, 2017, U.S. Appl. No. 13/589,471.
Nov. 21, 2017, U.S. Appl. No. 15/389,086.
Mar. 5, 2018, U.S. Appl. No. 14/920,432.
Mar. 14, 2018, U.S. Appl. No. 15/389,086.
Mar. 28, 2018, U.S. Appl. No. 15/389,086.
Jun. 15, 2018, U.S. Appl. No. 15/389,086.
Sep. 28, 2018, U.S. Appl. No. 13/589,471.
Oct. 16, 2018, U.S. Appl. No. 13/589,471.
Nov. 23, 2018, U.S. Appl. No. 14/920,432.
Jan. 15, 2019, U.S. Appl. No. 16/019,385.
Feb. 28, 2019, U.S. Appl. No. 14/920,432.
Mar. 26, 2019, U.S. Appl. No. 14/920,432.
May 7, 2019, U.S. Appl. No. 16/019,385.
May 1, 2020, U.S. Appl. No. 16/546,066.
Aug. 5, 2020, U.S. Appl. No. 16/455,510.
Aug. 14, 2020, U.S. Appl. No. 16/546,066.
Nov. 24, 2020, U.S. Appl. No. 16/211,023.
Feb. 26, 2016, U.S. Appl. No. 14/797,565.
Sep. 6, 2016, U.S. Appl. No. 14/797,565.
Nov. 7, 2016, U.S. Appl. No. 14/797,565.
Jan. 10, 2017, U.S. Appl. No. 14/797,565.
Feb. 9, 2021, U.S. Appl. No. 16/546,066.
Apr. 20, 2021, U.S. Appl. No. 16/455,510.
U.S. Appl. No. 17/522,272, filed Nov. 9, 2021.
U.S. Appl. No. 17/383,081, filed Jul. 22, 2021.
U.S. Appl. No. 17/316,976 dated Mar. 13, 2023.
U.S. Appl. No. 17/383,081 dated Apr. 7, 2023.

* cited by examiner

DOOR MONITORING SYSTEM

CROSS-REFERENCE TO RELATED APPLICATIONS

This application claims the benefit of U.S. Provisional Application No. 61/227,277 filed on Jul. 21, 2009. The entire disclosure of the above application is incorporated herein by reference.

FIELD

The present disclosure is related to door systems and, more specifically, to a method and system for monitoring door conditions suitable for predicting the need to service or adjust the door.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Installing doors into buildings under construction typically requires the assistance of various tradesmen. For example, for one opening, tradesmen such as carpenters, painters, glaziers, electricians, and drywallers are required to complete the installation of the door. Other tradesmen may also be used for the installation of the door. The number of tradesmen increases when the door has security or other specialty items incorporated near the door opening. Reducing the number of tradesmen will reduce the overall cost of the door when installation is included. Also, human error factors may also be reduced.

During operation doors may need adjustment to maintain operability. Various components on a door may include a hinge, latch, closer, and the like. Each of these components may require adjustment during the life of the door. Also, various codes such as fire codes and regulations may require the door to operate in a certain manner. Typically, a facility with multiple doors requires service technicians multiple man hours to travel from door-to-door to adjust each door to be in compliance with the specific code.

SUMMARY

The present disclosure provides a door system that monitors various operating conditions of a door using a sensor or combination of sensors to provide feedback to the various operating conditions. The door or multiple doors may be monitored at a central location and a service technician may be dispatched to service or provide preventive maintenance based upon the operating conditions of the door.

In one aspect of the invention, a door operator includes a first door skin and a second door skin spaced apart from the first door skin. The assembly also includes an energy sensor generating an energy signature signal and a memory storing a door component operating signature. A controller is coupled to the energy sensor and forms a comparison of the energy signature signal to the door component operating signature and generates a door component operation status signal in response to the comparison.

In another aspect of the invention, a method includes generating an energy signature signal during door operation, comparing the energy signature signal to a door component operating signature and generating a door component operation status signal in response to comparing.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
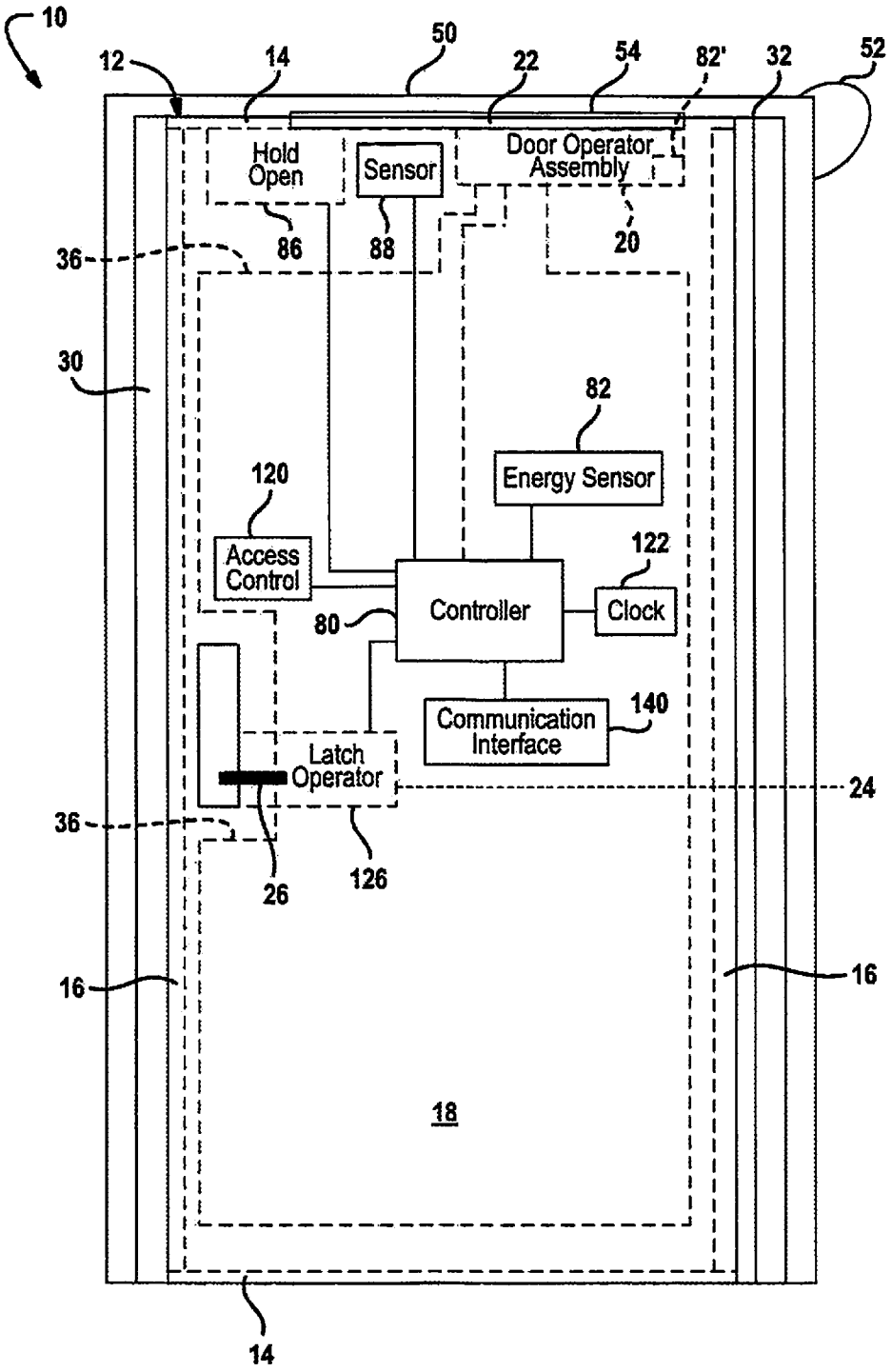
FIG. 1 is a front elevational view of a door assembly according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The following disclosure is applicable to many areas including, but not limited to, asset tracking, fire and life safety, personnel time and attendance, energy management, housekeeping, anti-ligature, and janitorial.

Referring now to FIG. 1, the present disclosure is set forth with respect to a door 10. The door 10 has a frame 12 that comprises horizontal stiles 14 and vertical stiles 16. The horizontal stiles 14 and vertical stiles 16 may be formed of a variety of materials, including wood, metal or a composite material.

The door 10 has a pair of outer faces 18, only one of which is illustrated in FIG. 1. The outer faces 18 may be referred to as "door skins." The outer faces 18 may comprise various materials, including metal, wood or composite materials. The interior of the door 10 between pieces of the door frame 12 and the door skins 18 may be filled with various materials, including, but not limited to, spacers and fire resistant materials, depending on the type of door.

As is described below, the door components may be located within the door, external to and on the door, adjacent to the door, or combinations thereof.

The door 10 may also include a door operator assembly 20. The door operator assembly 20 may be disposed within the door 10 between the door skins 18. The door operator assembly 20 may also be disposed on a door surface or at an area adjacent to the door. An arm 22 extending from the door operator assembly 20 may be used to position the door 10 and move the door into the desired position. The arm 22 may extend from the door operator to the door frame or to a track on the wall adjacent to the door frame.

A latch operator 24 may also be disposed within the door skin 18. The latch operator 24 is associated with a door handle 26 that latches and unlatches the door. The latch operator 24 may be an electrically-operated latch operator, such as a motor or solenoid. The latch operator 24 may be in communication with the door operator assembly 20 and may operate under the control of the door operator assembly 20. (Details of the operation of the door operator assembly 20 and the latch operator 24 will be provided below.) The latch operator 24 may be a mechanical operator that is electrically locked or operated in response to sensing the movement of the door handle 26. One example of a mechanical latch operator is a panic bar. The latch operator 24 may be in communication with a latch mechanism 30 that is used for latching the door 10 within an external frame, as described below. A hinge 32 is used for rotating the door 10 within the external frame. Both the latch mechanism 30 and the hinge 32 may extend vertically along the entire edge of the door 10.

A proximity sensor 36, such as an antenna, may also be incorporated within the door 10. By providing the proximity sensor 36 within the door 10, the aesthetic appeal of the door is maintained. The proximity sensor 36 may sense the approach of an object or person and the speed of an object or person, and allow the door operator assembly 20 to operate. The proximity sensor 36 is in communication with the door operator assembly 20.

The proximity sensor 36 may also be a wideband sensor or a radar sensor.

The door 10 is illustrated within an external door frame 50. The door frame 50 fastens the door 10 to a wall 52. The hinge 32 allows the door 10 to pivot about an axis within the frame 50. The door frame 50 may include or have an additional track 54 that allows the operator arm 22 to slide therein.

The door 10 may also include a controller 80. The controller 80 may be microprocessor-based. The controller 80 may perform various door operation status functions as will be described further below in FIG. 5. The door operation status corresponds with the movement or operation of the door and the conditions of various components associated therewith including the door operator assembly.

The controller 80 may be in communication with an energy sensor 82. The energy sensor 82 may sense various types of energy such as sound or vibration energy that is transmitted within the door. The energy sensor 82 may be an accelerometer. The accelerometer may be a multiple axis accelerometer or inertial sensor. For example, a two-axis XY accelerometer or a three-axis XYZ accelerometer may be used. The accelerometer 82 may be used for sensing various vibrations and sounds transmitted near or through the door from various components of the door. The accelerometer 82 may be located within or on the door since the sound and vibrations travel therethrough. The energy sensor 82 may also be located in various locations within the door. The energy sensor 82 may also be located outside the door such as on a door frame, hinge or adjacent wall. While only one energy sensor 82 is illustrated, multiple energy sensors may also be provided. The multiple sensors may be provided for redundancy or for more accurate sensing due to location. That is, energy sensors 82 may also be provided in different locations to provide better signals that correspond to the door operation. One example of a suitable location is a on a steel plate located between the door skins. The sensor 82 may be mounted to the steel plate and mounted within the door. Another way to mount the sensor is to have the sensor 82 mounted to a circuit board which is attached to the steel plate.

An example of another location of an energy sensor 82' is also illustrated. The energy sensor 82' may be within the door operator assembly 20. The energy sensor 82' may be used to produce signals corresponding to the operation of the door operator assembly 20. The signals may correspond to a motor operation or mechanical arm operation of the operator assembly 20, for example. Of course, the door operator assembly 20 may be monitored from the energy sensor 82. Also, the door operation may be monitored from the energy sensor 82'.

A signal conditioning and conversion block 83 may be used to filter or convert the signal to a more desirable form. Filtering may include band pass filtering or other types of electrical signal filtering. The signal conditioning and conversion block 83 may be used to shift the comparison signature over time. That is, the operating signature may be adjusted.

A clock timer 122 may also be in communication with the controller 80. A clock, timer or both may be provided. The clock 122 may provide various information to the controller such as a time since a last event, the actual date and time of an event, how long a cycle takes, or various other information. The length of the signature may also be measured. The clock 122 may generate a calendar date and time.

An access controller 120 may also be provided within the door. The access controller 120 may provide various types of access to the door and security for the door. The access controller 120 may include a card reader, a fingerprint detector, a retina detector, or various other types of access control such as a keypad.

The controller 80 may also be in communication with a communication interface 140. The communication interface 140 may allow the controller 80 to communicate with a central controller or with another controller of a door.

Figure 3:
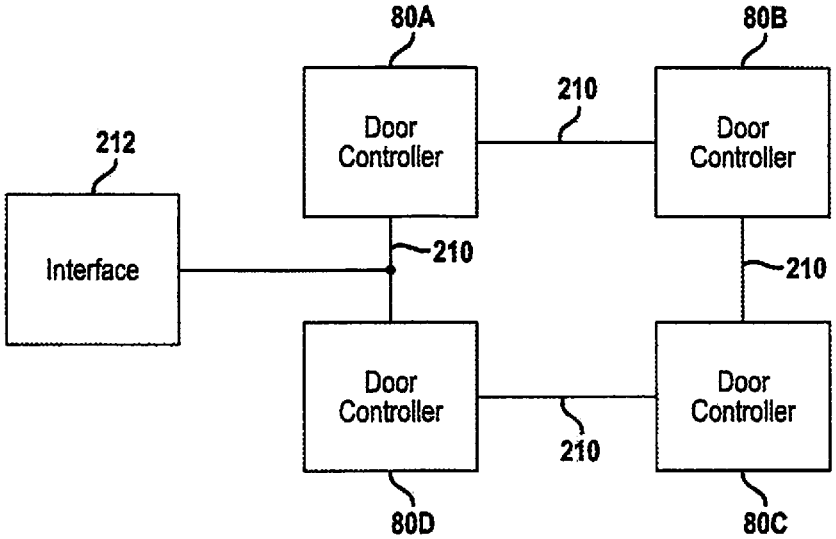
FIG. 3 is a simplified block diagrammatic view of a door system according to the present disclosure.
Figure 4:
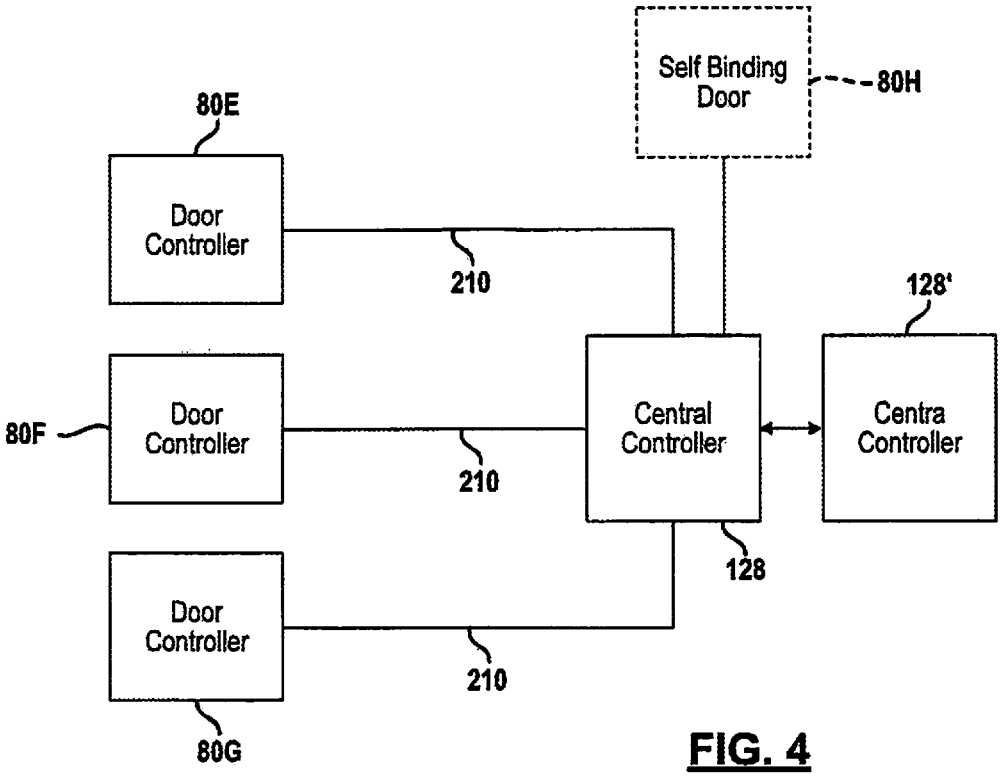
FIG. 4 is a simplified block diagrammatic view of an alternate door system according to the present disclosure.

Various types of networking configurations may be formed with the communication interface as will be further described in FIGS. 3 and 4.

A hold-open 86 may also be incorporated within the door. The hold-open 86 may operate in response to a sensor 88. The hold-open 86 is illustrated as mounted within the door, but may be also mounted on the door frame. The hold-open 86 holds the door open and in response to sensing a condition at the sensor 88, allows the door to close. The door may close under the operation of the door operator assembly 20. The sensor 88 may, for example, be a smoke detector, a chemical detector, a carbon-monoxide detector, a radiation detector, or other types of sensors that sense conditions suitable for closing a door. The sensor 88 may also be an RF sensor for reading RF identifiers from personnel, products, or various items. The location of different items or personnel may be communicated to a central monitoring system for tracking.

Figure 2:
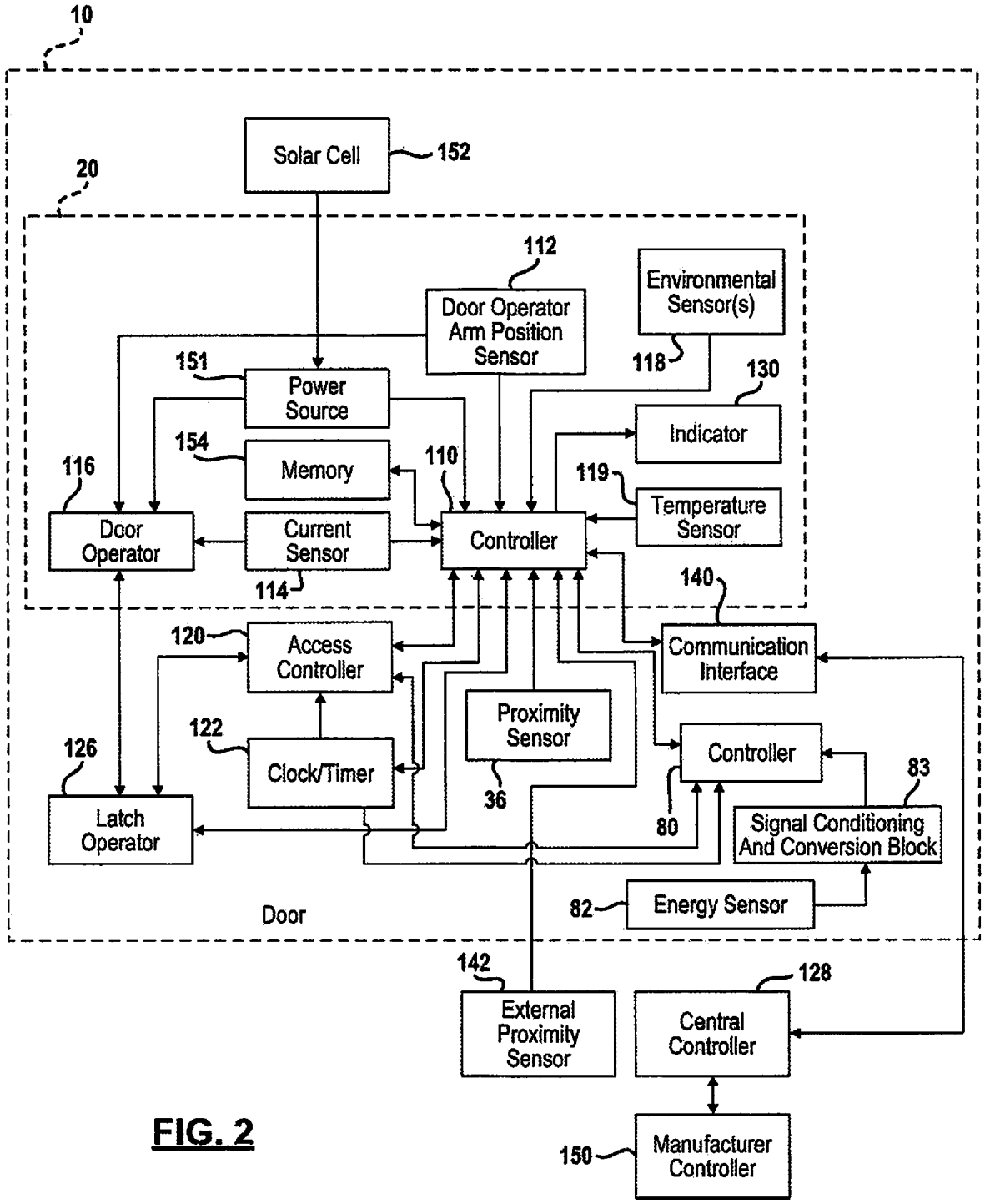
FIG. 2 is a block diagrammatic view of a door system according to the present disclosure.

Referring now to FIG. 2, the door 10 and the door operator assembly 20 are illustrated in further detail. The door operator assembly 20 includes a controller 110. The controller 110 may, for example, be a microprocessor-based controller. The controller 110 may be used to control various actions or outputs based upon various inputs.

The controller 110 may receive an input from a door operator arm position sensor 112. The door operator arm position sensor 112 that generates a signal corresponding to the angular position of the operator arm of FIG. 1. The angular position may be the position relative to the door 10. As the door 10 opens, the angular position signal corresponds to a larger angle than when the door is in a closed position. In a closed position, the angular position may be about zero. Various types of sensors may act as the position sensor 112, including a resistive sensor, a Hall Effect sensor, a pulse-counting sensor or an accelerometer that counts the amount of angular pulse signals from a door operator. Various types of sensors may be used.

A temperature sensor 119 may also be included in the system. For example, the temperature sensor 119 may be used for detecting fire or for energy management purposes. The temperature sensor 119 may trigger the closing of a door without further interaction. Such action may avoid spreading of fire.

The controller 110 may also be in communication with a current sensor 114. The current sensor 114 generates a current signal corresponding with the amount of current being applied to a door operator 116. The controller 110 may control a door operator 116. The door operator 116 may be various types of door operators, as will be described below. The door operator 116 may, for example, be a motor, a motor with a hydraulic pump or a pump with a plurality of gears, such as a rack gear or the like. By monitoring the current within the current sensor 114, the controller 110 can provide more or less opening force, change the velocity of the door opening or closing, or change the acceleration of the door opening or closing.

The controller 110 may also receive environmental signals from an environmental sensor 118. The environmental sensor 118 may be one sensor or a plurality of sensors that sense the environmental conditions around the door 10. One example of an environmental sensor 118 is a smoke detector that generates a smoke signal in response to a smoke condition. The environmental sensor 118 may also be a toxic agent sensor that generates a toxic agent signal in the presence of toxic agents. Various types of toxic agents may be sensed, including, for example, radiation. Light levels may also be sensed by the environmental sensor 118. That is, the environmental sensor 118 may be a light sensor that generates a light signal corresponding to the amount of ambient light within an area around the door 10.

The controller 110 may also be in communication with the access controller 120. The access controller 120 may provide access for latching and unlatching the door through a latch operator 126. The access controller 120 may be a PIN pad, a fingerprint recognition system, a voice recognition system, a retina recognition system, or various combinations of the above. The access controller 120 may also be a card reader or the like.

The access controller 120 may also be in communication with the clock 122 that records the time of various entries and exits through the door 10. In conjunction with the access controller 120, specific persons may be tracked based upon entry using the access controller 120. The access controller 120 may also monitor and track attendance of various assets and the movement of the access or attendance of various persons or access within a building. The access controller 120 and clock 122, in combination, may also unlock and lock various doors of a building based upon the calendar within the clock and the time associated with the clock.

The controller 110 may also control a latch operator 126. The latch operator 126 may be a mechanical-based or electrical-based latch operator. The latch operator 126 may be used to lock the door 10 based upon inputs from the clock 122 or other inputs such as those from a central controller 80. The latch operator 126 may allow the latch to be unlatched without the intervention of a person. By unlatching the door 10, the latch operator 126 may then be easily moved by the motor associated with the door operator 116 into the desired position.

The proximity sensor 36 may also be an input to the controller 110. The proximity sensor 36 may be one of a variety of sensors, such as the antenna illustrated in FIG. 1. Other types of proximity sensors 36 may be included within the door 10 and outside the door. For example, the proximity sensor 36 may be a motion detector that can gauge the speed of an approaching person or object and open the door 10 corresponding to the speed of the approaching person or object. One example of a suitable use is to sense the speed of an approaching gurney in a hospital environment. The proximity sensor 36 may also be a wall switch that activates door operator 116, or other type of sensing device, such as a floor-mounted pad sensor. The proximity sensor 36 may also generate a signal to the controller 110 that, in response the proximity sensor 36, unlatches the latch through the latch operator 126. Thus, a latch open signal may be generated by the controller 110 to unlatch the latch based upon a proximity signal corresponding to a person or object in proximity of the proximity sensor 36. The latch operator 126 may also generate a latch completion signal to signal the controller 110 that opening the door 10 is enabled since the latch is open.

The controller 110 may also be communication with an indicator 130. The indicator 130 may be an audible indicator, such as a buzzer, beeper or bell, or a visual indicator, such as a light-emitting diode, a display or a light. Audible signals, visual signals or both may be used in a particular system. The indicator 130 may generate an indicator in response to an alarm. By knowing that a particular door should not be opening and when the arm position sensor 112 generates a signal corresponding to the opening of the door during a guarded time period, the indicator 130 may generate an indicator corresponding to an alarm.

The controller 110 may also be in communication with a communication interface 140 and the controller 80. The communication interface 140 may communicate with the central controller 80 or other door controllers of a building. The communication interface 140 generates signals in the proper format and potentially with encryption to the central controller 80. The controller 110 may communicate alarm signals to the central controller 80 through the communication interface 140. The controller 80 may communicate door operation signals to the central controller 80. The central controller 80 may also generate control signals to the controller 110 to change various time periods associated with the door 10, such as lock-down times, door-opening times, speeds and accelerations.

The central controller 80 may also be in communication with the manufacturer controller 150. The central controller 80 may also be eliminated in various situations. The manufacturer controller 150 may provide the manufacturer with various information and data about the door assembly, including the alignment of the door, the position of the door, the compliance of the door with certain regulations, and the like. The manufacturer controller 150 may allow the manufacturer to obtain various information to improve the manufacturing process of the door system. The manufacturer controller 150 may, in certain situations, take the place of a central controller 80. It is envisioned that a central controller 80 may be located within a facility such as a hospital or plant. A manufacturer controller 150 may take the place of the central controller 80 by informing the building owners of the various conditions monitored by the central controller 80. A building owner may thus pay the manufacturer to monitor various building conditions for a monthly fee as negotiated during the time of the purchase of the door.

It should also be noted that the door operator 20 is an optional component of the door 10. As well, the hold-open 86 illustrated in FIG. 1 is also an optional component.

An external proximity sensor 142 may also be in communication with the controller 110. The external proximity sensor 142 may be a wall-mounted switch or motion-detecting device that communicates a proximity sensor signal to the controller 110.

A power source 151 may be in communication with the door operator assembly 20. The power source 151 may, for example, be in communication with the door operator 116 and the controller 110. Other devices within the door 10 may be in communication with the power source 151. The power source 151 may be a battery that is used to operate the door operator assembly 20. The power source 151 may be located between the door skins 18. The power source 151 may be a rechargeable power source that is recharged by a solar cell 152. The power source 151 may also be easily removable so it can be readily replaced.

The power source 151 may also be a power source external to the door. Facility power such as 24 volts AC or DC may be used. Other voltages such as 110 volts, 220 volts may be used. In such case a transformer may be used to reduce the voltage to the desired level. The transformer may be located on, in or near the door.

A memory 154 is illustrated in the door operator assembly 20 but may also be included in various locations within the door assembly 10. The memory 154 may be used to store a profile, signature or other door operating data. The memory 154 may also be in communication with controller 80.

It should be noted that all or some combination of components may be used in a particular door. For example, a door may include the memory 154 and an energy sensor without a controller at the door. Some means for communicating the data from the memory 154 may be provided. For example, the signatures may be stored and obtained by a service technician through a wireless connection or through the communication interface 140. This may allow simplified electronics associated with a door while allowing the analysis to be performed at another location. This may reduce the cost of the system. For example, a cell phone connection or wireless connection may allow a monitoring location to analyze the signatures to determine various maintenance or wear issues. In one example, a technician with a cell phone or PDA may move about a facility from area to area and collect data. A laptop computer may also be used. A cellular or mobile phone hardware in the communications interface may allow the door to "call back" data to a central controller such as a manufacturer controller or building management controller. A connector may also be provided that is in communication with the memory 154. The memory 154 may be read directly by another device and stored in the other device.

Referring now to FIG. 3, each opening of a building may include a door having a door controller 80A-80D. As is illustrated, four door controllers are provided in a daisy-chain configuration wherein each door controller 80A-80D communicates with at least one other door controller. Communication lines 210 allow each door controller to intercommunicate. The communication lines 210 may also be wireless connections. The status of each door and the components within each door may be communicated through the communication line 210. A power line carrier may also be used for communication to eliminate the need for distinct data lines. The door controllers 80A-80D may form a network. A serial data bus may be used for intercommunications. Addressing may be used to route packets through the network from end to end. The network may be a peer-to-peer network or a master-slave network.

The communication lines 210 may also be coupled to an interface 212. The interface 212 may be an interface to a wired phone line, a broadband network, a wireless connection, a satellite communication system, twisted pair and may communicate with an open or proprietary protocol. The communication lines may also use the same type or different type of communication as the interface 212. The interface 212 may communicate with police or fire dispatch upon the detection of an emergency condition or to communicate a maintenance condition from the door controllers 80A-80D to a central controller or manufacturer controller.

Referring now to FIG. 4, a central controller 80 is illustrated being directly coupled to each door controller 80E-80G. The central controller 80 may also be coupled to the integrated door units through a ring, star, daisy-chain, loop configuration, or by radio frequency. The central controller 80 may be used for monitoring various operating conditions of the door and be provided to dispatch service technicians in the event a door is out of compliance with various codes or is in need of repair. The communication lines 210 may also be wireless.

The central controller 80 may also be in communication with another central controller 80'. The central controller 80' may be in communication with a plurality of doors. Data regarding the various doors may be exchanged between central controllers 128, 128'. The central controller 80 may also be in communication with one or more doors that collect data from other doors. One door may be used in the communication with the central controller.

A self-binding door 80H may also be in communication with the central controller 128. A self-binding door may connect to the network and binds itself to the system upon installation. That is, the self-binding door 80H may provide an identifier to the central controller 128 which is also communicated to each of the door controllers 80E-80G. A self-binding door 80H may also be included in the configuration set forth in FIG. 3 without a central controller. In such a case, one door controller will communicate with the self-binding door after which time each existing door controller will be provided the door identifier of the self-binding door. Any door may be preconfigured in a factory setting to become part of the network when installed. Further, a door may be configured by an installer using an electronic device such as a computer. The operator device may be used for invoking services, binding variables and assigning addresses.

One of the door controllers 128, 128' may act as a leader door in communication with multiple door controllers. The intelligence may be included in doors to "vote" on notifying a central controller of various conditions. Various door controllers may report their status to a leader door which then communicates with other doors on whether or not their statuses are problematic to the point where a user needs to be notified. The leader door may communicate directly with the central controller.

The doors may intercommunicate in a mesh network. That is, the doors may act as part of a network for forwarding data to a central controller.

Figure 5:
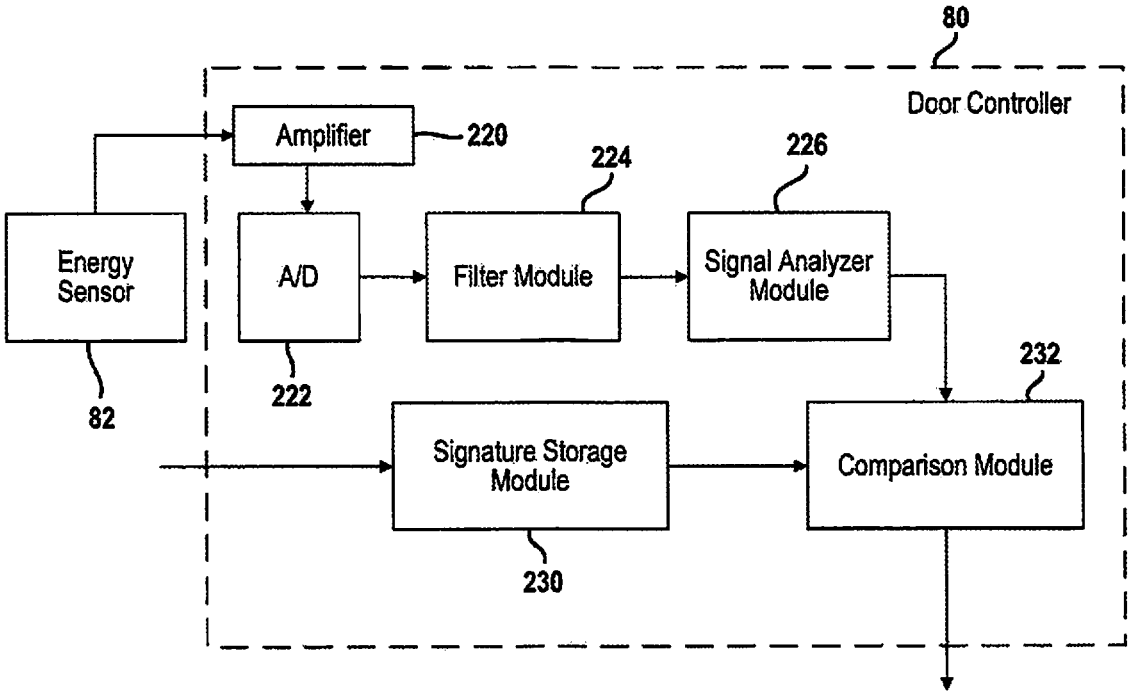
FIG. 5 is a partial block diagrammatic view of the controller of FIG. 1.

Referring now to FIG. 5, a controller 80 is illustrated in further detail. The controller 80 is coupled to one or more energy sensors 82/82' such as an accelerometer. The signal from the accelerometer or energy sensor 82 may be an analog signal. The signal may be amplified in an amplifier 220 associated with the controller 80. The amplifier may amplify or condition the analog signals. The system may also function in either an analog form or digital form. In a digital form, an analog-to-digital converter 222 converts the analog signal from the amplifier or the accelerometer 82 into a digital signal. A filter module 224 may also be provided within the controller. The filter in this configuration is a digital filter used for filtering the digital signals. It should also be noted that the filter module 224 may be located before the amplifier 220 or analog-to-digital converter 222 and be an analog filter. Both the amplifier 220 and the filter module 224 may be optional components.

A signal analyzer module 226 may be contained within the controller 80. The signal analyzer module 226 may analyze and process various aspects of the signal from the filter module 224. The signal analyzer module 226 may form a signature of the sensor signal. For example, the frequency, the amplitude, the period and the harmonics of the sensor signal provided from the filter module 224 may be analyzed to form the signature signal. The frequency domain (spectral analysis) may be used to perform the analysis. Fast Fourier Transforms (FFT) tuned analog filters, Discrete Fourier Transforms (DFT), or other time-to-frequency conversions may be used to provide frequency analysis for the signal. Various frequencies and amplitudes in the signature signal from the energy sensor may correspond to various conditions. The signatures may be a time versus frequency plot as is illustrated below.

A signature storage module 230 may also be provided. The signature storage module 230 may be a memory that is used to store various signatures corresponding to various components. Normal component signatures as well as component signatures for components that are wearing and require maintenance may be provided.

The comparison module 232 may compare the signatures stored within the storage module 230 to the signature from the signal analyzer module 226. The output of the comparison module 232 may provide a pass or fail indicator or provide various data such as a certain component needing service or adjustment to be in compliance with various codes.

Examples of signatures and components that may be monitored include monitoring for the correct installation according to the manufacturer's specifications, monitoring the operation of the door operator and monitoring the operation of the latch. Compliance with fire codes or other codes and regulations may also be determined.

The comparison module 232 generates a door operation status symbol that may correspond to a properly adjusted component. A number of door component operation status signals may be provided at any one time.

Examples of door component operation status signals may correspond to an improperly adjusted door operator. An improperly adjusted door operator may provide too high of a swing speed or too low of a swing speed. Another example of a door status signal may include a door position signal. The accelerometer may be used to generate the door position based upon the acceleration and thus the velocity of the door. From the acceleration and the determined velocity, a door position signal may be generated. Multiple signatures and multiple components may be checked using the door component operation status signals.

Another example of using the signature signal in relation to a door operator is also contemplated. In a door operator, the various sensors included therein may eventually stop functioning properly. When a sensor does not function anymore, the door component operation status signal may be used to predict when a sensor has failed. For example, the signature signal may be used to recognize when a door is hand-pushed as opposed to when the door operator operates the door. When the operator fails to open the door, a person may hand-push the door to open. This may be sensed by the accelerometer or energy sensor. Thus, by comparing the signature signal of the energy sensor with a "pushed door" signal, the controller will know when the door is being hand-operated. If the door should be operated with the door closer, a failure signal may be generated corresponding to a failed sensor. The failed sensor signal may be communicated to a central controller so that service may be dispatched. In this embodiment, the lack of operation of a door sensor or a failure of a door sensor, particularly that of a sensor within the door operator, may be sensed. The signature may correspond to a door being pushed while the operator should have been opening. Of course, other sensor failures could be determined in a similar manner. The signature may thus be used for predicting what did not happen based on what happened. That is, the door being pushed may indicate that a door sensor such as the proximity sensor may have failed and the operator did not open the door. The operation or lack of operation of other components within the door operator may also be monitored. For example, the lack of operation of the motor, the proximity sensor, the arm position sensor, and other components may be inferred.

The door component operation status signal may also include an operation status for the latch. The latch may be detected as being out of compliance when the latch stop is not aligned with the door. Another detection is that the latch may not be securely latching.

The door component operation status signal may also include a hinge status signal which may provide a hinge squeaking signal or an indication that the hinge is binding and not operating properly.

Another example of a door operation status may be a door alignment status. The alignment status may correspond to the door alignment with the frame or the ground. Thus, the door clearance status may provide a door-to-frame clearance or a door-to-ground clearance indicator. When the door is not fit properly within the frame, the door may rub against the frame and thus generate a particular vibration signature. Likewise, when the door rubs upon the ground, the door may also provide an energy signature that is recognizable.

The door status signals may also correspond to an abuse of the door, such as kicking in the door or when heavy forces have been applied to the door. The door being slammed shut or slammed open may also be an operation indication. In any of the above cases, the communication interface is used to provide to some controller an indication of the operating status and compliance with the various codes. A maintenance indication or compliance indication may be provided in response to the comparisons.

It should also be noted that the amplification and filtering may be provided so that the noise from various adjacent doors and other external sources may be filtered out so as not be considered in the signal analyzer module 226.

Preventive maintenance may also be determined in the system. Based upon the number of door operations as provided by the energy sensor and by the energy signals provided from the sensor, various preventive maintenance items may be performed at various times.

The signature may also be used to provide a central operator an indication that someone is trying to hang themselves from the door. The system may be used in an anti-ligature capacity since the accelerometer can be used to detect a downward force corresponding to the weight of a person. This may be helpful in a hospital or healthcare facility.

The energy sensor 82 may be sensitive to the operating conditions of adjacent doors. That is, various signatures for adjacent doors may be sensed by the monitored door. The adjacent door may not have any electronic hardware therein.

Figure 6:
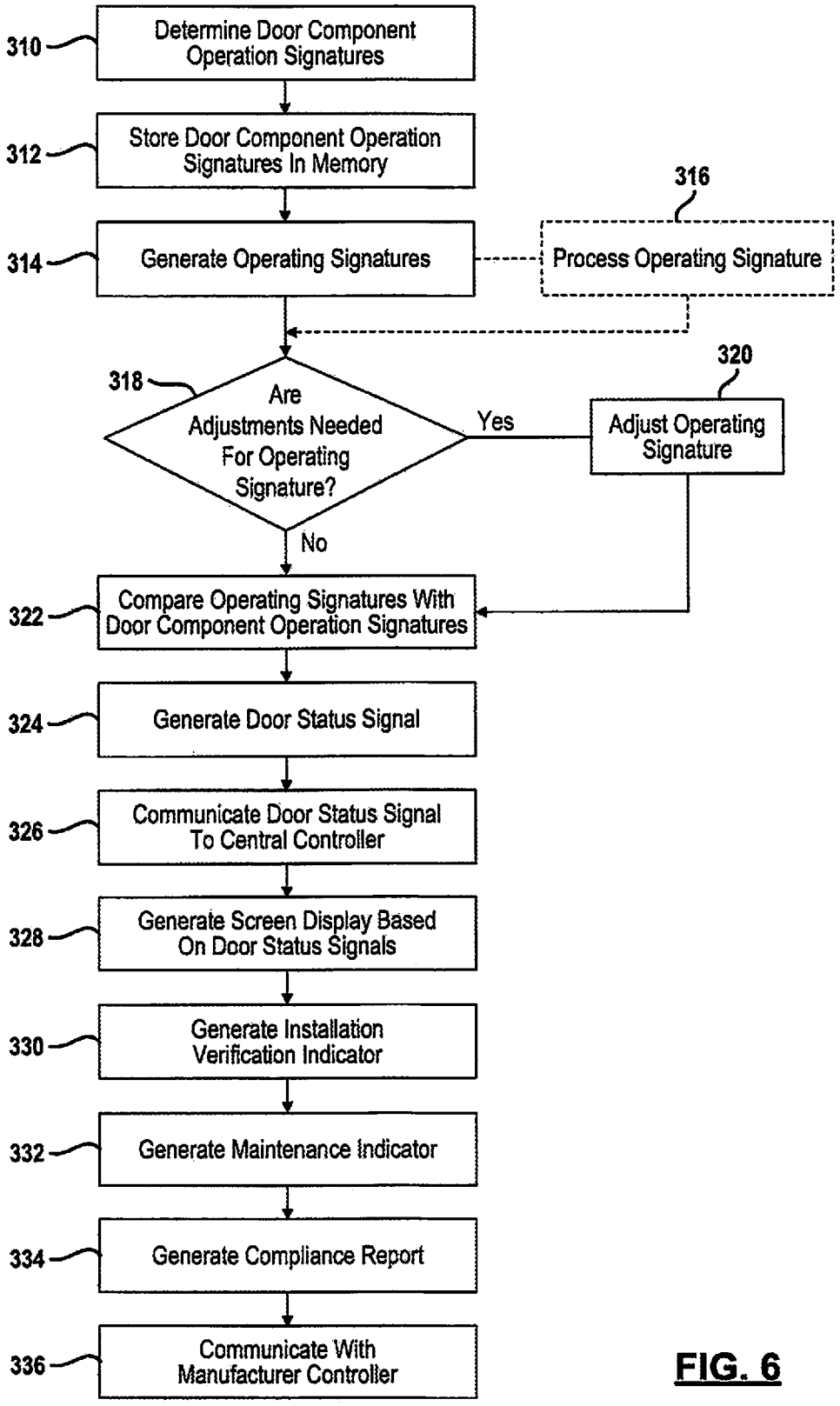
FIG. 6 is a flowchart of a method for operating the door system according to the present disclosure.

Referring now to FIG. 6, a method of operating the door system is set forth in further detail. In step 310, the door component operation signatures may be determined. The door component operating signatures may correspond to properly operating doors or of improperly operating door components. As mentioned above, various operation signatures may be determined experimentally and loaded within a memory in the door. The door operation signatures may change depending on the various components. The door operation signatures may be determined in a lab using faulty components so that signatures may be obtained. Typically, a facility may purchase several identically configured doors and thus each of the doors may have identical component failure signatures.

In step 312, the door operation signatures are stored in a memory within the door controller. As mentioned above, adjacent door signals may also be collected. This is suitable for doors without electronics. In step 314, the operating signatures are generated during the operation of the door. The signatures may be collected or communicated to a location for analysis or analyzed at the door. In step 316, an optional step of processing the signature may be performed. The operating signature may be processed by filtering, analog-to-digital conversion, and Fast Fourier Transforms as mentioned above. Some or all of the processing may be performed on a particular sensor signal. After steps 314 or 316, step 318 determines whether operating adjustments are needed for the signatures. Some signatures may require adjustment over time due to wear and other factors. In step 318, if adjustment of the signatures is required, step 320 adjusts the signature. As mentioned above, the signature itself or threshold may be changed due to various conditions.

Step 322 compares the operating signature with the door component operation signatures. The operating signature from the sensor may be compared with various door component operation signatures stored within the memory. Numerous door component operation signatures may be provided for testing various components and adjustments. Adjustment and threshold-type determinations may be provided. When the operating signature reaches a predetermined level, adjustments may be required whereas when a component reaches another level, replacement of the particular component may be required. The comparison may take place using a numerical analysis such as a best fit type algorithm or using fuzzy logic so as to obtain a substantial match.

Based upon the comparison, a door status signal may be generated in step 324. The door status signal may actually be a variety of status signals corresponding to various components. As will be described below, various door status component signals may be displayed at a central controller to provide an operator an indicator that maintenance or servicing may be required. In step 326, the door status signal is communicated to a central controller. A screen display may be generated based upon the door status signals. It should also be noted that an indication of installation may be provided. Thus, an installation verification indicator may be generated on a screen display in step 330.

A maintenance indicator 332 may also be generated. The maintenance indicator 332 may provide an indicator that maintenance is required for a particular component. A compliance report may also be generated by the central controller in step 334. The compliance report may provide an indicator that the particular door is in compliance with various codes or regulations.

In step 336, the door status signals may also be communicated to a manufacturer. The manufacturer may be interested in obtaining signals so that the installation may be verified. Installation verification may be a pre-condition to warranty conditions. Also, as mentioned above, the central controller may be eliminated for a manufacturer controller. The manufacturer controller may provide monitoring service for a particular facility having various numbers of doors. The manufacturer may also provide service technicians based upon the door status signals.

Figure 7:
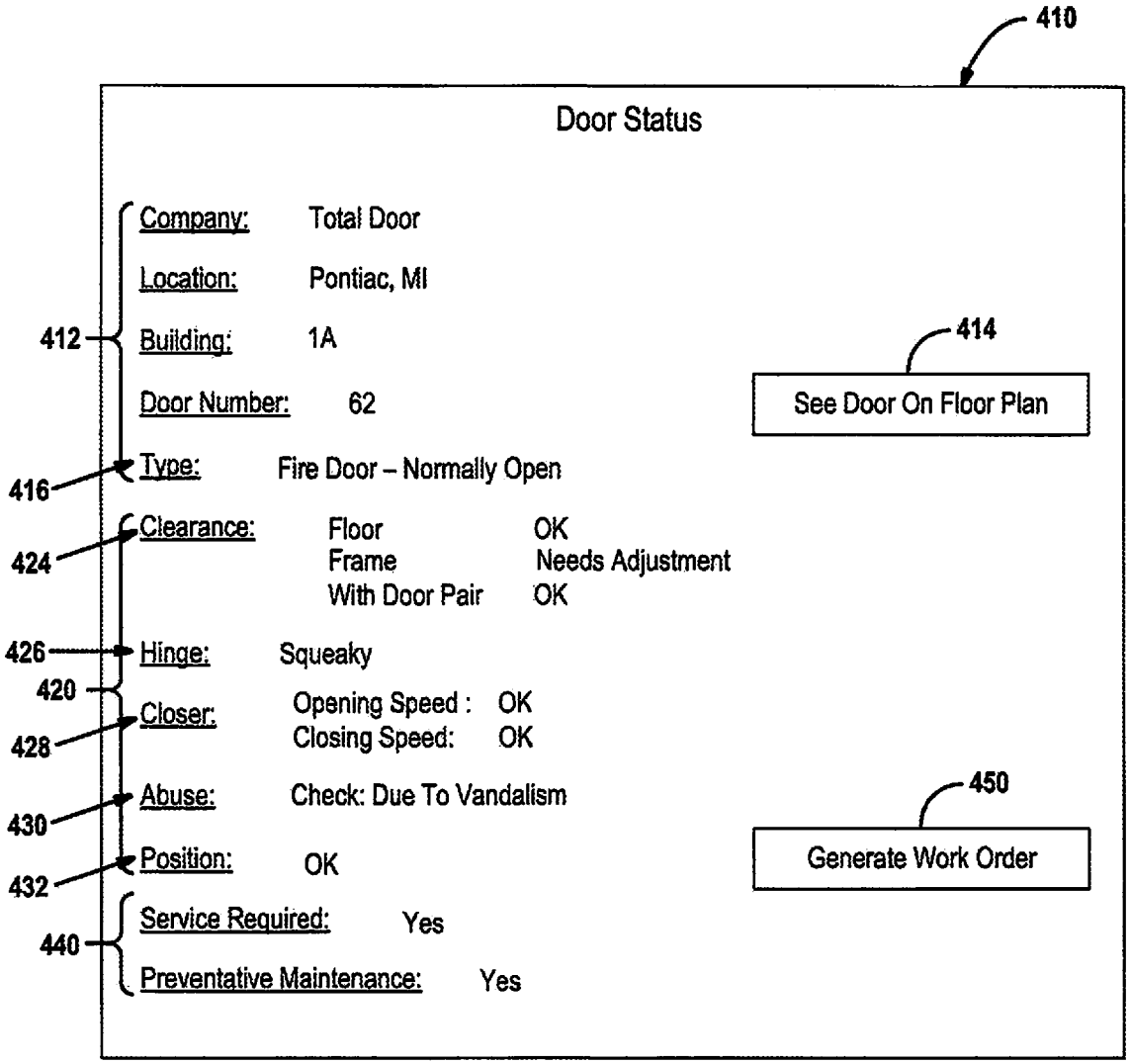
FIG. 7 is a graphical user interface for a door monitoring system according to the present disclosure.

Referring now to FIG. 7, a graphical user interface 410 of a door status may be provided. The door status indicator may provide the graphical user interface at either the manufacturer controller, the central controller, or both. Various types of location data 412 may be provided on the graphical user interface 410. In this example, the company, the location, the building and the door number may all be provided. Of course, in a central controller the company may be only one company and thus not be required. In any case, some indication as to the door location is provided in the graphical user interface 410. In the graphical user interface illustrated, a floor plan button 414 may be provided so that a floor plan illustrating the location of the particular door may be displayed and/or printed.

A type of door indicator 416 may also be provided in the graphical user interface 410. The type of door may correspond to various types of doors such as a fire door. If only one type of door is monitored by a particular facility, this indicator may be eliminated.

Door status indicators 420 may also be provided. The door status indicators 420 may include various types of data including clearance data 424, hinge data 426, closer data 428, abuse data 430, and position data 432. Clearance data may include various types of clearance of the door, such as relative to the floor or relative to the frame. As is illustrated in FIG. 7, the floor clearance is OK while the frame may need adjustment. The clearance may also be provided relative to a second door in a door pair. If the clearance is OK, an OK status may be generated.

The hinge indicator 426 may indicate a squeaky hinge or that the hinge may require adjustment of screws or the like. The hinge status may also indicate that a hinge may need replacement.

The closer indicator 428 may include an opening speed or a closing speed. By monitoring the opening and closing speed, the door closer may be adjusted to provide proper closing speeds. In this embodiment, the door opening speed and closing speed have provided an indication of acceptable. An abuse indicator 430 may be provided to detect abuse of the door. Kicking of the door, slamming the door open or closed may require checking and thus the abuse indicator 430 may provide various instructions. The position indicator may provide the relative position of the door opening and closing. If the door position is unacceptable, an indicator may be provided. In this embodiment, the door position indicator 432 indicates the door's position is OK. A status indicator 440 may also be provided. The status indicator in this embodiment illustrates a service required indicator or a preventive maintenance required indicator. The service required indicator in this embodiment is illustrated as YES meaning that service may be required on a component. A preventive maintenance indicator may also be provided to illustrate that preventive maintenance may also be required for the particular door. A work order button 450 may also be provided in the graphical user interface 410. The work order button may generate a printed work order from a printer, or the like. The work order may also provide an electronic work order to a mobile computing platform or a graphical display device. The work order may provide similar indication as to the door position and the types of adjustments necessary.

Figure 8:
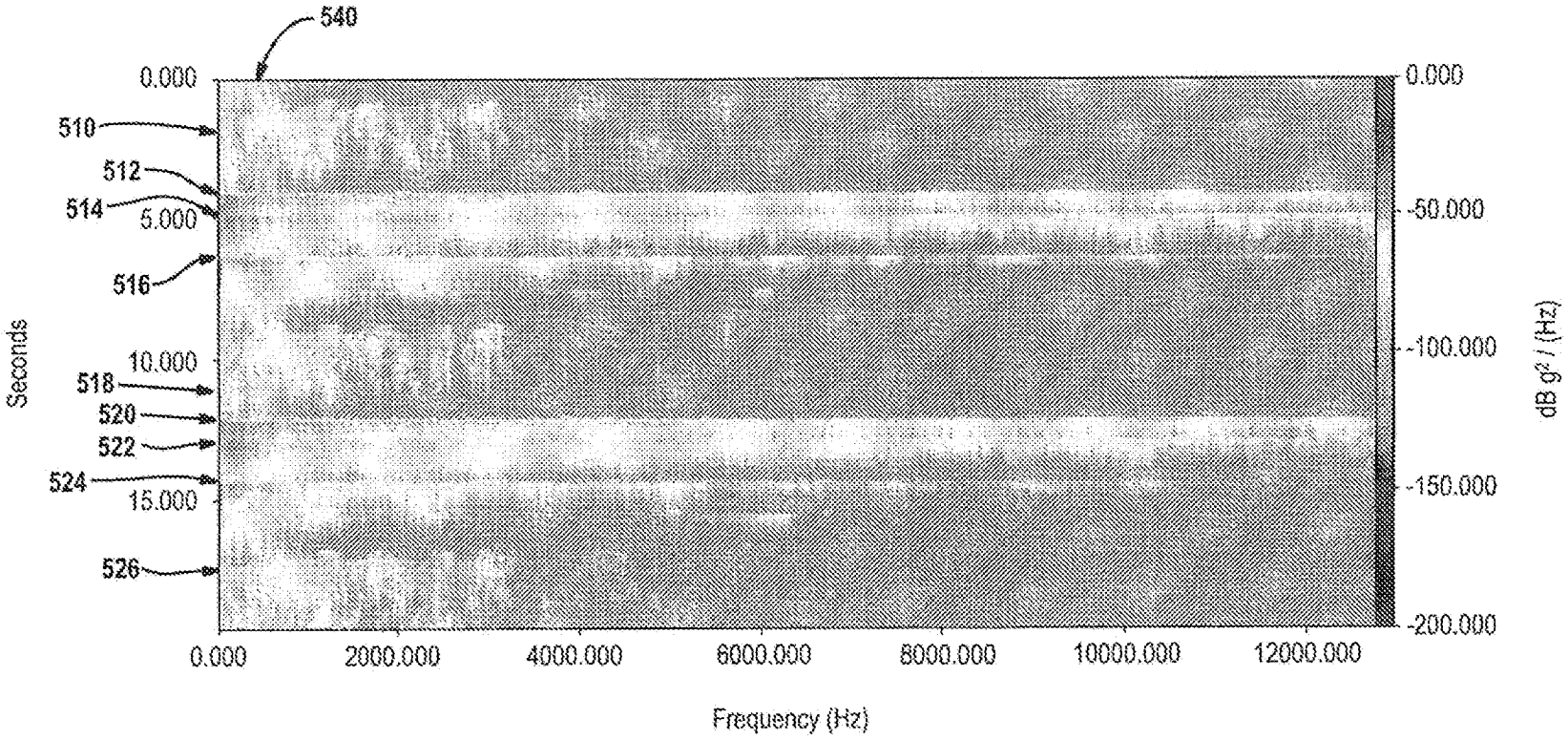
FIG. 8 is a time versus frequency plot of the door used in FIG. 8 after the hinges were wiped down with cleaning solution.

Referring now to FIG. 8, a plot of time versus frequency is illustrated for various impulse events corresponding to the opening of an automated door. The color of the plots illustrates the intensity of the sound. The sound was measured using a three-axis inertial sensor attached to the door. The door closes in region 510 before the first impulse event 512. The first impulse event corresponds to a latch latching shut. At impulse 514, the automatic door arm engages the door and pushes it outward. The third impulse event at 516 corresponds to the push bar releasing. The door swings outward in region 518, the process then repeats the sequence in regions 520, 522, 524 and 526. A squeak or whine is illustrated by the region 530. Harmonics of the region 530 also appear in the plot.

Figure 9:
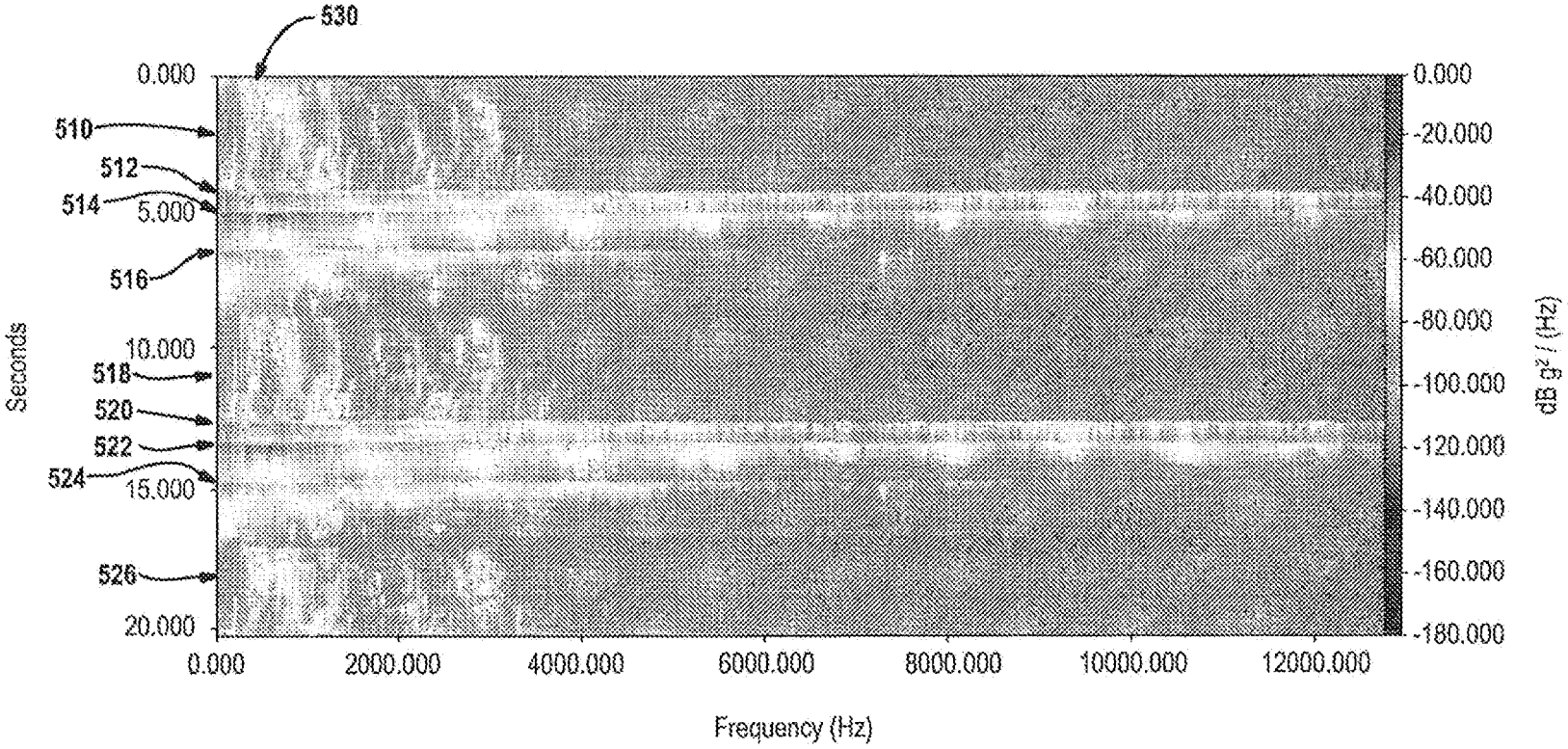
FIG. 9 is a time versus frequency plot for impulse events corresponding to the opening of an automated door.

Referring now to FIG. 9, the same door that was tested in FIG. 8 was again tested after the hinges were wiped down with cleaning solution to reduce squealing. The squealing at region 540 has been reduced as compared to region 530 during the closing illustrated as region 542.

Figure 10:
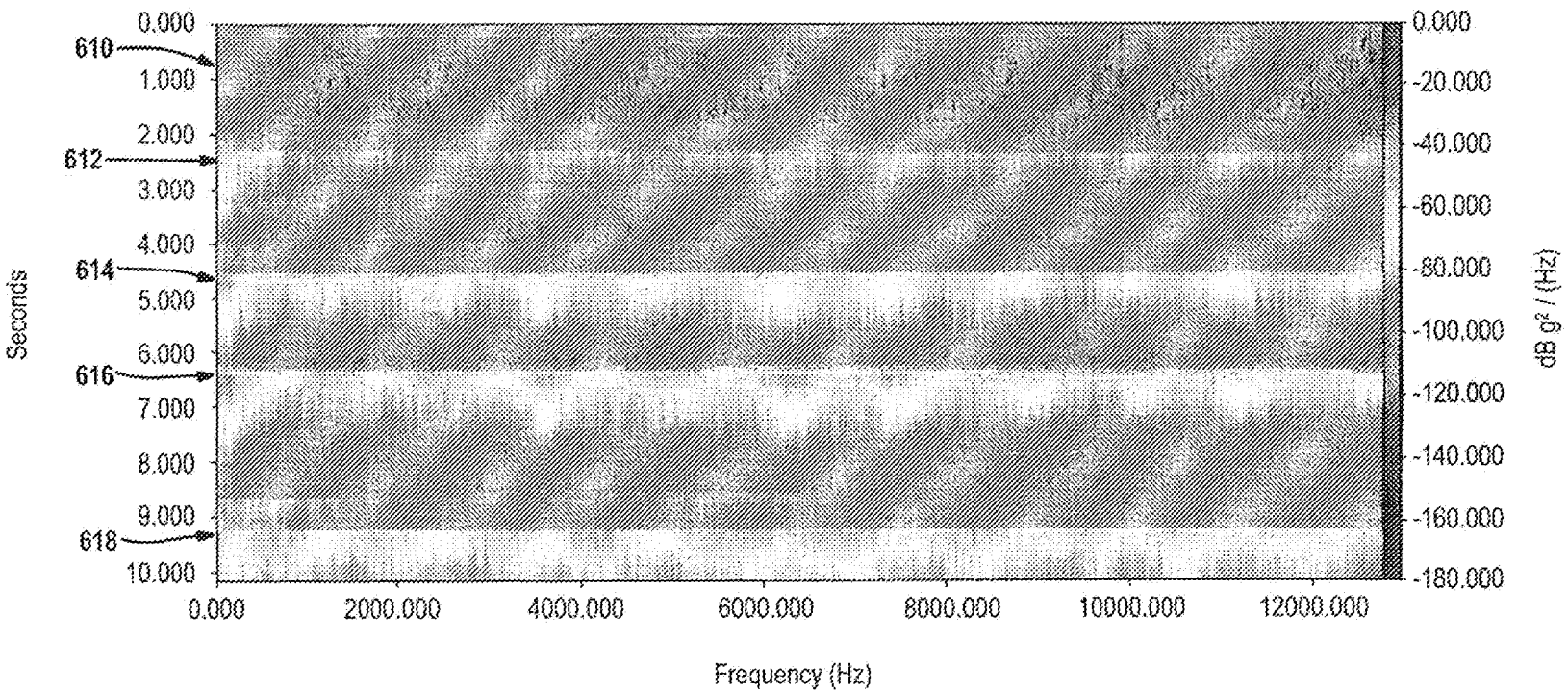
FIG. 10 is a time versus frequency plot of a steel door with a standard closer.

Referring now to FIG. 10, a steel door with a standard closer and handle is illustrated. In region 610, the door begins to open. At impulse 612, the door unlatches. At regions 614 and 616, the clearance below the door has been obstructed by a concrete hump. At point 618, the door begins to close and again strikes the concrete hump in the floor. The door in FIG. 10 is different than that of FIGS. 8 and 9.

Figure 11:
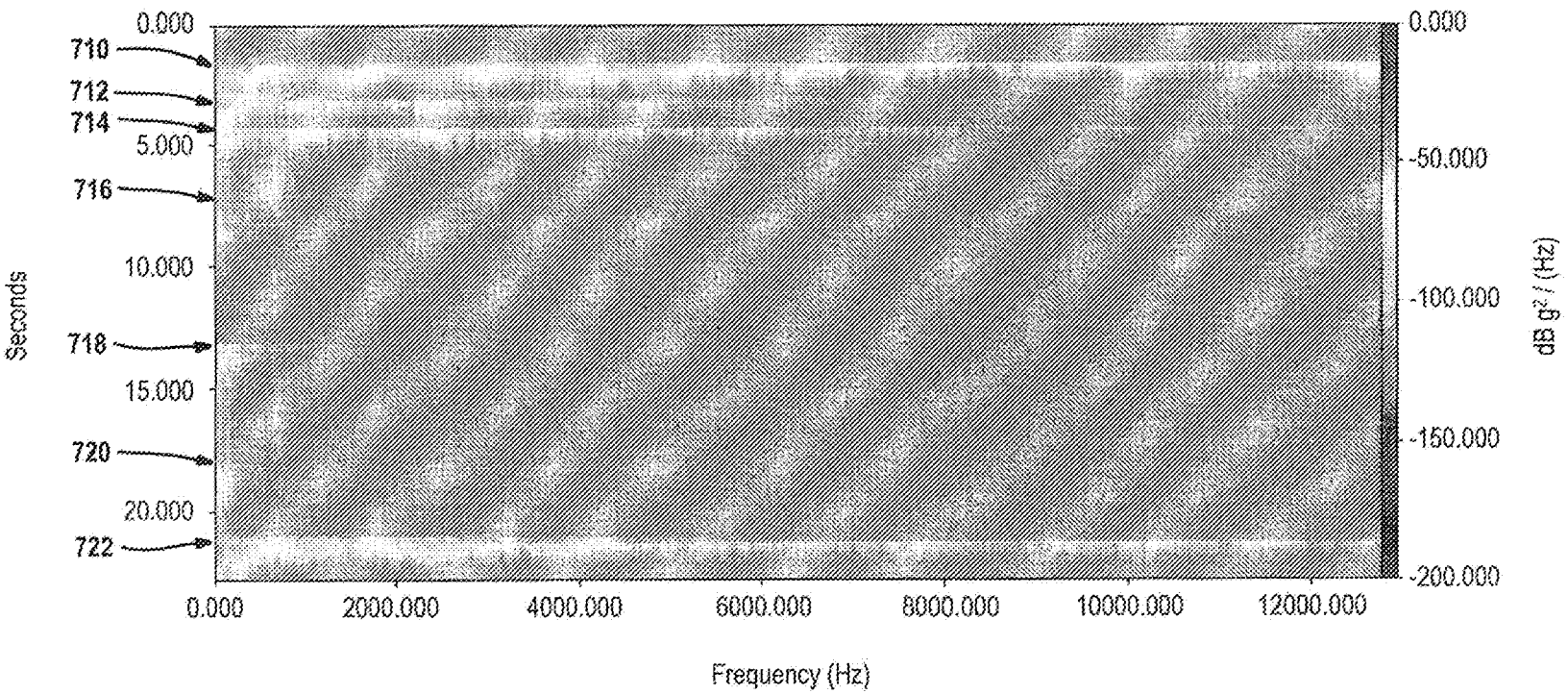
FIG. 11 is a time versus frequency plot of an automated pair of doors.

Referring now to FIG. 11, a pair of automatic doors were tested. The automatic doors operated from a switch plate that triggers the latch and door motors. At impulse 710, a solenoid is energized. At impulse 712, the latch is unlatched and at impulse 714, the solenoid is released. At region 716, the door is operated until the open position is reached. A slight impulse at 718 illustrates the reversing of the door movement and in region 720 the door is closed until it is latched at impulse 722.

Figure 12:
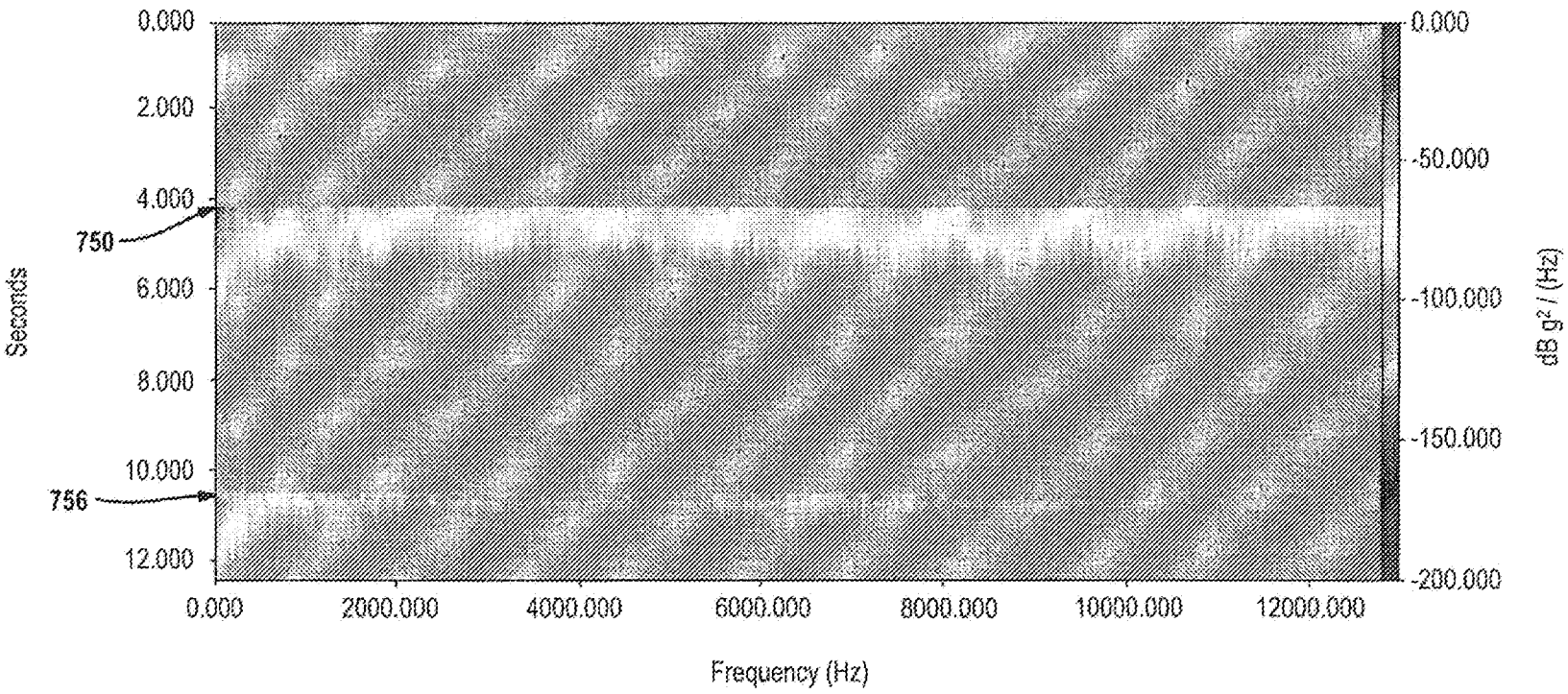
FIG. 12 is a time versus frequency plot of a door that was pushed open.

Referring now to FIG. 12, a door was pushed open. At impulse 750, the door was pushed open rapidly and forcefully. Impulse 756 illustrates the door closing and relatching.

As can be seen from the above plots, various signatures illustrate that various conditions of the door operation may be monitored. By making comparisons between the signatures of an operating door and the signatures of various faulty events, the door may be serviced.

Figure 13:
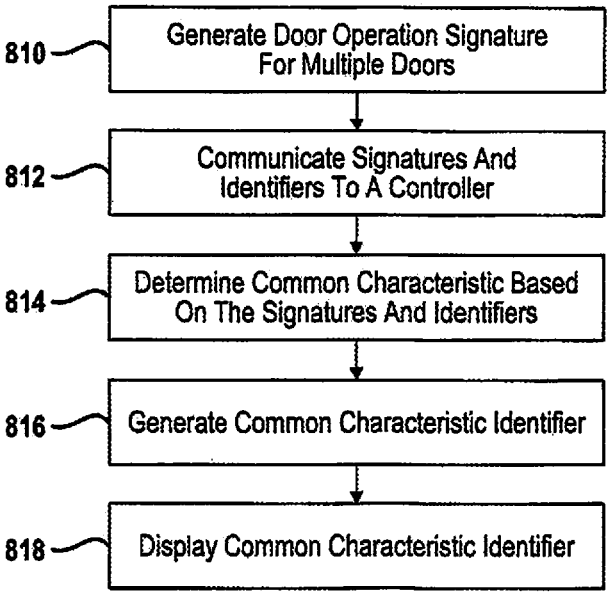
FIG. 13 is a flowchart of a method for aggregating door information.

Referring now to FIG. 13, aggregated door information for various locations may be provided to help diagnose common traits. By way of example, the system may receive information from all doors in a particular geographic region and determine that a failure rate of a certain component is high compared with the same component in other geographic regions. This may allow predictive maintenance algorithms to be changed for various locations. Statistical analysis, pattern-matching, and the like may be used to perform these changes. These changes may be local or based upon a particular facility. The method begins in step 810 in which door operation signatures for multiple doors is provided. In step 812, the multiple signatures are communicated to a controller. The controller may be various types of controllers such as a central controller located within a building or another controller such as a manufacturer controller or a corporate-owner controller. It is envisioned that a corporation owning multiple facilities may have a central monitoring system associated therewith.

In step 814, the common characteristics based upon the signatures and identifiers are provided. The identifiers may correlate to various geographic locations and the like. Based upon the signatures, various patterns determined by statistical analysis pattern-matching, or the like may be determined. In step 816, common characteristics are identified from the receive signatures. In step 818, a common characteristic identifier is provided to an operator of the system. The common characteristic identifier may, for example, identify a specific component that requires more frequent maintenance due to its location or generate a change in a maintenance algorithm.

Figure 14:
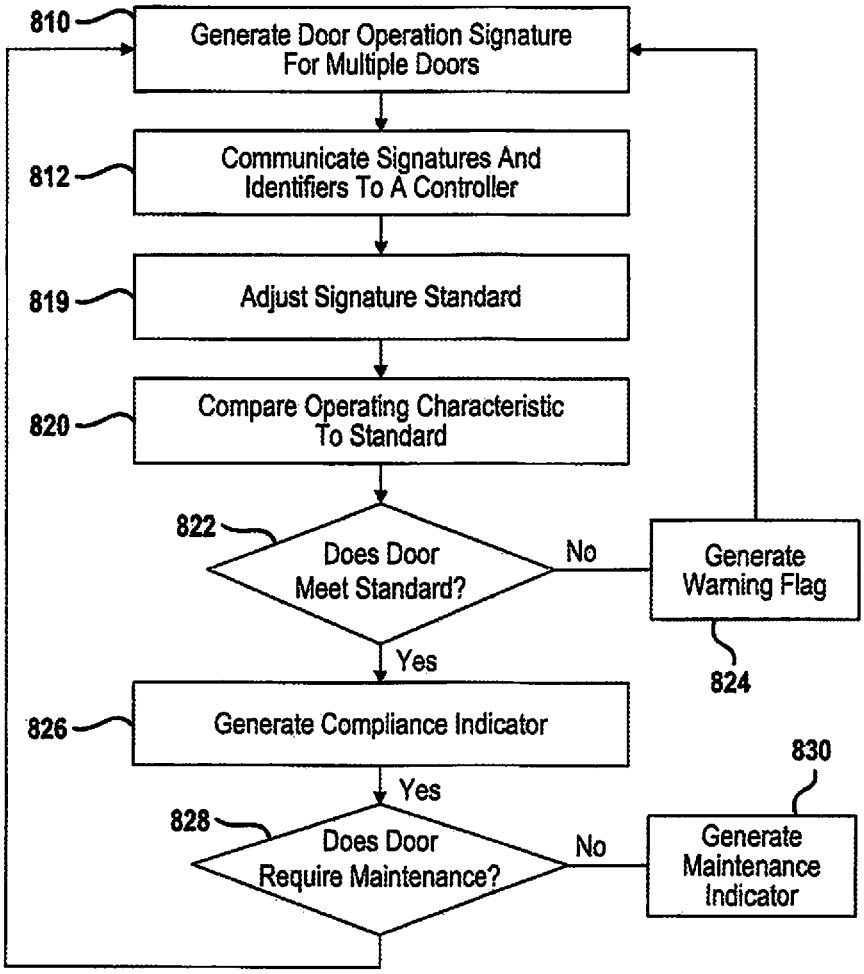
FIG. 14 is a flowchart of a method for continuous commissioning and monitoring of a door and any required maintenance associated therewith.

Referring now to FIG. 14, the present system may also be used for continuous commissioning of a door system. Steps 810 and 812 are identical to those in FIG. 13 and thus are not described below. In step 819, the standard or signature may be adjusted over time. That is, adjustments may be made due to wear or the like based on time or time of use. Of course, only some comparisons may be adjusted. After communicating the signatures to a controller, step 820 compares the operating characteristics of the doors to a standard or building code. In step 812, if the door does not meet the standard, a warning flag is generated in step 824. The warning flag may be generated on a screen display associated with a central controller or a manufacturer controller.

After step 822, when the door does meet the standard, a compliance indicator may be provided in step 826. The compliance indicator may be provided on a screen display at one of the various controllers associated with the system.

By looking at the various characteristics, it may be determined whether a door requires maintenance. In step 828, if the characteristics are indicative that maintenance is required, a maintenance indicator may be generated in step 820. If no maintenance is required in step 828, step 810 is again performed. It should be noted that the door may be continuously commissioned in FIG. 14. That is, the system may continually monitor various doors at predetermined intervals to insure compliance with various building codes or agency standards. It should also be noted that the continuous commissioning may also report the types of doors that are installed in the building to insure that the correct doors are installed. For example, upon manufacturing, a controller may be embedded with a specific "type identification." When the type identification is brought into the system when the door is commissioned, the user controller may recognize the door type necessary for that particular location.

FIG. 14 may also be used for a retrofitting of an existing door with technology to allow the particular door to report within the system. By determining the type of door, whether a door is proper for the particular opening may be determined. This may prevent an improper door for the particular opening from being installed.

Figure 15:
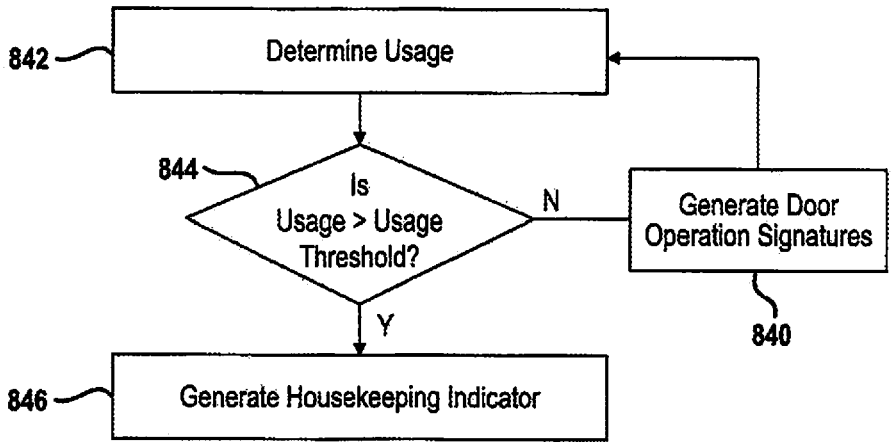
FIG. 15 is a flowchart for a method for determining whether janitorial or housekeeping services are required based upon door usage.

Referring now to FIG. 15, a method for utilizing the system for janitorial and housekeeping purposes is set forth. In step 840, door operating signatures are generated. The door operating signatures may be generated for all doors but doors with entry into a predetermined location may be grouped together to determine the possibility of wear and tear. In step 842, the usage of a room is determined based upon the door operation signatures. If a room is used or entered more often than others, there is a good chance that it will require cleaning or other maintenance more frequently. This is especially true in a facility with multiple restrooms.

In step 844, it is determined whether the usage is greater than a usage threshold. When a usage is greater than a usage threshold, step 846 generates a housekeeping indicator to the system operator. In step 844, when the usage is not greater than a usage threshold, step 840 is again performed. Thus, the need for housekeeping and janitorial services may continually be monitored.

Figure 16:
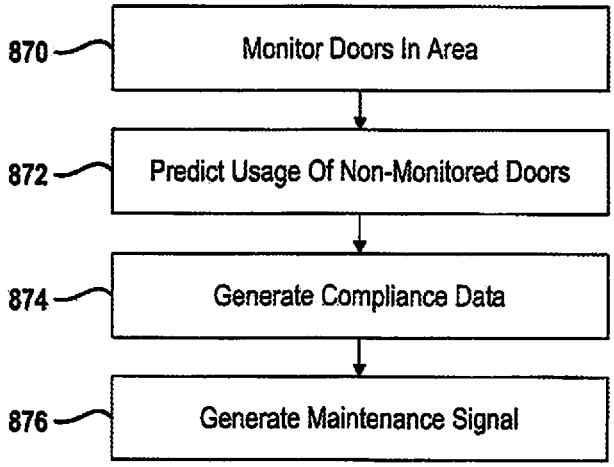
FIG. 16 is a method for predicting the usage of an unmonitored door.

Referring now to FIG. 16, the system may also be used for virtualized doors. A virtualized door may be a door created by the controller representing a door that is installed without intelligence. Characteristics of the door may be inferred by the controller through monitoring other nearby intelligent doors. For example, if a room has three doors and only two are monitored, when a door opens but no exit event is seen, the inference is that a patron exited through the door without sensors. The method for monitoring a virtualized door begins in step 870 in which the doors for an area are monitored. The operating signatures are used in monitoring. In step 872, the usage of non-monitored doors is predicted. As mentioned above, this may be predicted by monitoring other doors within the area. In step 874, compliance data may also be generated for the particular non-monitored door in step 874. In step 876, a maintenance signal may be generated based upon the predicted usage. The maintenance signal may alert the system operator that maintenance may be required for a non-monitored door.

The present system may also be suitable for variations due to the usage of the particular door. Various algorithms may change depending on the deployment of the door. For example, in a fast-food restaurant, a specific algorithm for a door may be different than that of a school door, despite the doors being identical in the hardware and sensor packages.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A method for monitoring a door assembly, the door assembly comprising a door, a door frame, and a hinge connecting the door to the door frame, the method comprising:

attaching an energy sensor to an external portion of the door, an external portion of the door frame, or a location adjacent to the door, generating an energy signature signal with the energy sensor during door operation, comparing the energy signature signal to a door component operating signature stored in a memory, and generating a door component operation status signal in response to the comparing, wherein the comparing is performed by a controller, the controller is in communication with a central controller or manufacturer controller, and the central controller or manufacturer controller generates an installation verification indicator.

2. The method of claim 1, wherein the energy sensor comprises an accelerometer.

3. The method of claim 1, wherein the energy sensor comprises a multi-axis accelerometer.

4. The method of claim 1, wherein the door component operation status signals correspond to a latch status.

5. The method of claim 4, wherein the latch status comprises a latch stop not aligned with the door.

6. The method of claim 4, wherein the latch status comprises a latch not securely latching.

7. The method of claim 1, wherein the door component operation status signals comprise a hinge status.

8. The method of claim 7, wherein the hinge status comprises a hinge squeaking.

9. The method of claim 7, wherein the hinge status comprises a hinge binding.

10. The method of claim 1, wherein the central controller or manufacturer controller further generates a compliance with codes and/or regulations report.

11. The method of claim 1, wherein the central controller or manufacturer controller further generates a maintenance indicator.

12. The method of claim 1, wherein the energy sensor senses sound.

13. A method of monitoring a plurality of door assemblies in a facility, wherein each door assembly of the plurality of door assemblies in the facility comprises a door, a door frame, a hinge connecting the door to the door frame, the method comprising:

providing an energy sensor, generating an energy signature signal with the energy sensor for each door of the plurality of door assemblies, comparing each energy signature signal to a door component operating signature stored in a memory, generating a door component operation status signal for each door in response to the comparing, and communicating each door component operation status signal to a central controller or manufacturer controller, wherein the energy sensor is attached to an external portion of the door, an external portion of the door frame, or a location that is adjacent to the door, and the central controller or manufacturer controller generates an installation verification indicator.

14. The method of claim 13, wherein the door component operation status signals correspond to a latch status.

15. The method of claim 14, wherein the latch status comprises a latch not securely latching.

16. The method of claim 13, wherein the door component operation status signals comprise a hinge status.

17. The method of claim 13, wherein the central controller or manufacturer controller further generates a compliance with codes and/or regulations report.

18. The method of claim 13, wherein the central controller or manufacturer controller further generates a maintenance indicator.

19. The method of claim 13, wherein the energy sensor comprises an accelerometer.

20. The method of claim 13, wherein the energy sensor senses sound.

* * * * *